United States Patent [19]

Wake

[11] Patent Number: 4,924,517

[45] Date of Patent: May 8, 1990

[54] ENCODER OF A MULTI-PULSE TYPE CAPABLE OF CONTROLLING THE NUMBER OF EXCITATION PULSES

[75] Inventor: Yasuhiro Wake, Tokyo, Japan

[73] Assignee: NEC Corporation, Tokyo, Japan

[21] Appl. No.: 305,924

[22] Filed: Feb. 3, 1989

[30] Foreign Application Priority Data

Feb. 4, 1988 [JP] Japan ..... 63-22902
Sep. 14, 1988 [JP] Japan ..... 63-231250

[51] Int. Cl.[5] ..... G10L 5/00
[52] U.S. Cl. ..... 381/40

[58] Field of Search ..... 381/29-50

[56] References Cited

U.S. PATENT DOCUMENTS 4,716,592 12/1987 Ozawa et al. ..... 381/40

*Primary Examiner*—Emanuel S. Kemeny
*Attorney, Agent, or Firm*—Foley & Lardner, Schwartz, Jeffery, Schwaab, Mack, Blumenthal & Evans

[57] ABSTRACT

In a multi-pulse excitation encoder, the number of pulses is controlled in accordance with an updated correlation signal compared to a predetermined value.

5 Claims, 9 Drawing Sheets

| PULSE NUMBER | 19 | 21 | 25 | 27 | 30 | 39 | 45 | 55 |
|---|---|---|---|---|---|---|---|---|
| CODED VALUE | 0 | 1 | 2 | 3 | 4 | 5 | 6 | 7 |
| BIT NUMBER OF THE PULSE NUMBER SIGNAL | 3 | 3 | 3 | 3 | 3 | 3 | 3 | 3 |
| BIT NUMBER OF THE ENCODED K PARAMETER SIGNAL | 35 | 35 | 35 | 35 | 35 | 35 | 35 | 35 |
| BIT NUMBER OF THE NORMALIZATION INFORMATION | 7 | 7 | 7 | 7 | 7 | 7 | 7 | 7 |
| 1st QUANTIZATION BIT NUMBER | 8 | 7 | 6 | 5 | 4 | 3 | 2 | 1 |
| 2nd QUANTIZATION BIT NUMBER | 6 | 6 | 5 | 5 | 5 | 4 | 4 | 4 |
| TOTAL BIT NUMBER | 311 | 318 | 320 | 315 | 315 | 318 | 315 | 320 |

ENCODER OF A MULTI-PULSE TYPE CAPABLE OF CONTROLLING THE NUMBER OF EXCITATION PULSES

BACKGROUND OF THE INVENTION

This invention relates to an encoder of a multi-pulse type for use in encoding a speech signal into a plurality of excitation pulses.

A conventional encoder of the type described is disclosed in U.S. Pat. No. 4,716,592 issued to Kazunori Ozawa et al and assigned to the instant assignee.

In the encoder, the speech signal is divided into a sequence of frames or segments. The speech signal is encoded into a plurality of excitation pulses by the use of a pulse calculating method. The encoder therefore comprises a pulse calculating unit for carrying out the pulse calculating method. The pulse calculating unit calculates a predetermined number of excitation pulses for each frame. Each of the excitation pulses has an amplitude and a location determined by the speech signal. Excitation pulse information representing the amplitude and the location is transmitted from the encoder to a decoder which is used as a counterpart of the encoder. The decoder decodes the excitation pulse information into a decoded signal and outputs the decoded signal as a synthesized speech signal.

Generally speaking, when the speech signal has a low pitch frequency, the speech signal can be characterized by a small number of excitation pulses. The decoder can therefore produce a favorable synthesized speech signal regardless of the number of the excitation pulses. On the other hand, when the speech signal has a high pitch frequency, the speech signal must be characterized by a large number of excitation pulses.

In the encoder, the predetermined number of the excitation pulses has, however, been constant regardless of the pitch frequency of the speech signal. This means that the synthesized speech signal may have a degraded quality when the speech signal has a high pitch frequency.

In the meanwhile, another encoder is disclosed in U.S. Pat. Application Ser. No. 153,290 filed Feb. 4, 1988, by Taguchi and assigned to the instant assignee. Briefly, the encoder comprises a detecting unit for detecting electric power level in response to the speech signal to produce a detection signal. The encoder further comprises a processing unit for processing an excitation pulse sequence to produce a processed signal in accordance with the detection signal. The processing unit comprises an extractor for extracting a plurality of excitation pulses in accordance with the detection signal to produce extracted excitation pulses as the processed signal. In the encoder, the number of the excitation pulses is variable. However, waste calculation for the excitation pulses is carried out because several excitation pulses are thinned out in the extractor.

SUMMARY OF THE INVENTION

It is therefore an object of this invention to provide an encoder of a multi-pulse type, which is capable of controlling the number of the excitation pulses without waste calculation.

It is another object of this invention to provide an encoder which is suitable for a counterpart decoder capable of producing a synthesized speech signal with a high quality.

An encoder to which this invention is applicable is for encoding a speech signal into an encoded signal. The speech signal is divided into a succession of frames. The encoder includes first means responsive to the speech signal for calculating a sequence of factors in each of the frames to produce a factor signal representative of the factors, second means responsive to the speech signal for calculating cross-correlation in each of the frames to produce a cross-correlation signal representative of the cross-correlation, and pulse sequence calculating means responsive to the speech signal, the factor signal, and the cross-correlation signal for calculating a plurality of excitation pulses in each of the frames. The pulse sequence calculating means updates the cross-correlation signal to an updated cross-correlation signal when the pulse sequence calculating means calculates each of the excitation pulses. The updated cross-correlation signal is for use in calculating a next one of the excitation pulses.

According to this invention, the encoder further comprises control means responsive to the updated cross-correlation signal for producing a control signal. The pulse sequence calculating means stops calculation of the excitation pulses at a controlled number of excitation pulses in response to the control signal. The control means is responsive to the controlled number of excitation pulses for producing a pulse number signal representative of the controlled number.

Figure 1:
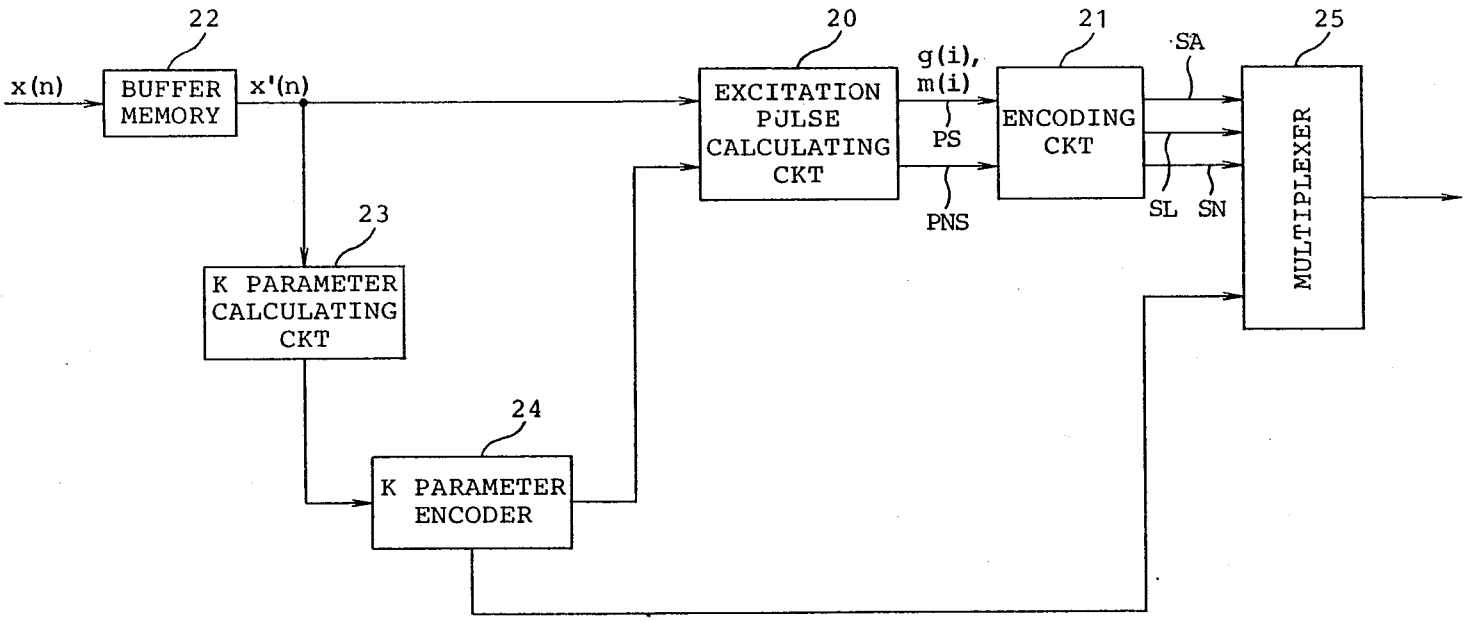
FIG. 1 is a block diagram of an encoder according to an embodiment of this invention.
Figure 2:
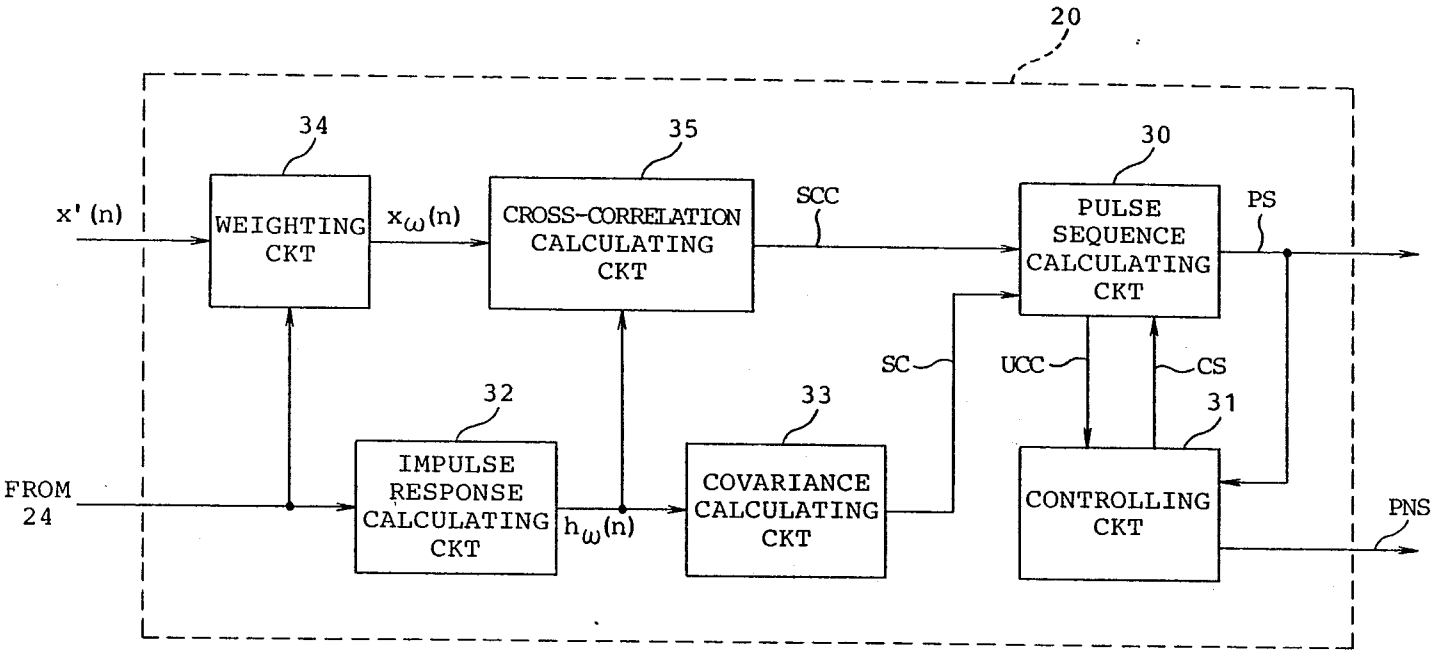
FIG. 2 is a block diagram of an excitation pulse calculating circuit included in the encoder illustrated in FIG. 1.

DESCRIPTION OF THE PREFERRED EMBODIMENTS:

Referring to FIGS. 1 and 2, description will be made as regards an encoder of a multi-pulse type according to a first embodiment of this invention. Except for an excitation pulse calculating circuit 20 and an encoding circuit 21, the encoder is disclosed in the Ozawa et al patent referred to hereinabove. The description will therefore be made briefly.

A digital signal x(n) is derived from a speech or voice signal in a known manner. The digital signal x(n) is divided into a succession of frames each of which is arranged within a time interval of, for example, 20 milliseconds, and comprises N samples determined by a sampling frequency. Description will be directed to only one digital signal frame of the digital signal x(n) merely for brevity of description.

Each frame is stored in a buffer memory 22 as a stored digital signal x'(n) and is sent to a k parameter calculating circuit 23. Responsive to the stored digital signal x'(n), the k parameter calculating circuit 23 calculates first through N-th k parameters in the manner known in the art and produces a k parameter signal representative of a k parameter k(i). In the following, the letter "i" will be used to represent either all of or each of 1 through N. The k parameter signal is supplied to a k parameter encoder 24. The k parameter encoder 24 encodes the k parameter signal into an encoded k parameter signal represented by a predetermined number of quantization bits. The encoded k parameter signal represents an encoded k parameter ek(i) and is supplied to a multiplexer 25. The k parameter encoder 24 further decodes the encoded k parameter signal to a decoded k parameter signal representing a decoded k parameter k'(i). The decoded k parameter signal is supplied to the excitation pulse calculating circuit 20.

Responsive to the stored digital signal x'(n) and the decoded k parameter signal, the excitation pulse calculating circuit 20 calculates a plurality of excitation pulses in a manner which will later be described in detail. The number of the excitation pulses is variable in each of the frames. The excitation pulse calculating circuit 20 supplies the encoding circuit 21 with a pulse signal PS representing an amplitude g(i) and a location m(i) of each of the excitation pulses and a pulse number signal PNS representing the number of the excitation pulses. As will later be described in detail, the encoding circuit 21 encodes the amplitude g(i) and the location m(i) into an encoded amplitude signal SA and an encoded location signal SL. The encoding circuit 21 further encodes the pulse number signal PNS into an encoded pulse number signal SN. The encoded amplitude signal SA, the encoded location signal SL, and the encoded pulse number signal SN are supplied to the multiplexer 25. The encoded k parameter signal, the encoded amplitude signal SA, the amplitude location signal SL, and the encoded pulse number signal SN are collectively called an encoded signal.

The multiplexer 25 multiplexes the encoded k parameter signal, the encoded amplitude signal SA, the encoded location signal SL, and the encoded pulse number signal SN into a multiplexed signal and transmits the mu1tiplexed signal to a decoder through a transmission line. If circumstances require, the multiplexed signal is once memorized in a memory and then supplied to the decoder.

Referring to FIG. 2, description will proceed to the excitation pulse calculating circuit 20. The pulse calculating circuit 20 is similar to that disclosed in the Ozawa et al patent except for a pulse sequence calculating circuit 30 and a controlling circuit 31.

An impulse response calculating circuit 32 is supplied with the decoded k parameter signal from the k parameter encoder 24 (FIG. 1). Responsive to the decoded k parameter signal, the impulse response calculating circuit 32 calculates an impulse response of the decoded k parameter signal and produces an impulse response signal $h_{107}$ (n) representative of the impulse response. The impulse response signal $h_\omega(n)$ is supplied to a covariance calculating circuit 33. Responsive to the impulse response signal $h_\omega(n)$, the covariance calculating circuit 33 calculates covariance and delivers a covariance signal SC representative of a sequence of covariance factors to the pulse sequence calculating circuit 30. The covariance signal SC serves as a factor signal.

On the other hand, a weighting circuit 34 is supplied with the stored digital signal x'(n) and the decoded k parameter signal. The weighting circuit 34 weights the stored digital signal x'(n) by the use of the decoded k parameter signal and delivers a weighted digital signal $x_{107}$ (n) to a cross-correlation calculating circuit 35. The cross-correlation calculating circuit 35 calculates cross-correlation between the weighted digital signal $x_\omega(n)$ and the impulse response signal $h_\omega(n)$. The cross-correlation calculating circuit 35 delivers a cross-correlation signal SCC representative of a sequence of cross-correlation factors to the pulse sequence calculating circuit 30.

Responsive to the cross-correlation signal SCC and the covariance signal SC, the pulse sequence calculating circuit 30 calculates an excitation pulse sequence in a manner which will shortly be described in detail.

The pulse sequence calculating circuit 30 updates cross-correlation signal to an updated cross-correlation signal when the calculating circuit 30 calculates each of the excitation pulses. The updated cross-correlation signal is for use in calculating a next one of the excitation pulses. Responsive to the updated cross-correlation signal depicted by UCC, the controlling circuit 31 produces a control signal CS to stop calculation of the pulse sequence calculating circuit 30. Supplied with the control signal CS, the pulse sequence calculating circuit 30 produces a controlled number of excitation pulses as the pulse signal PS. Responsive to the pulse signal PS, the controlling circuit 31 counts the number of the excitation pulses as will later be described and produces a count result signal as the pulse number signal PNS.

Figure 3:
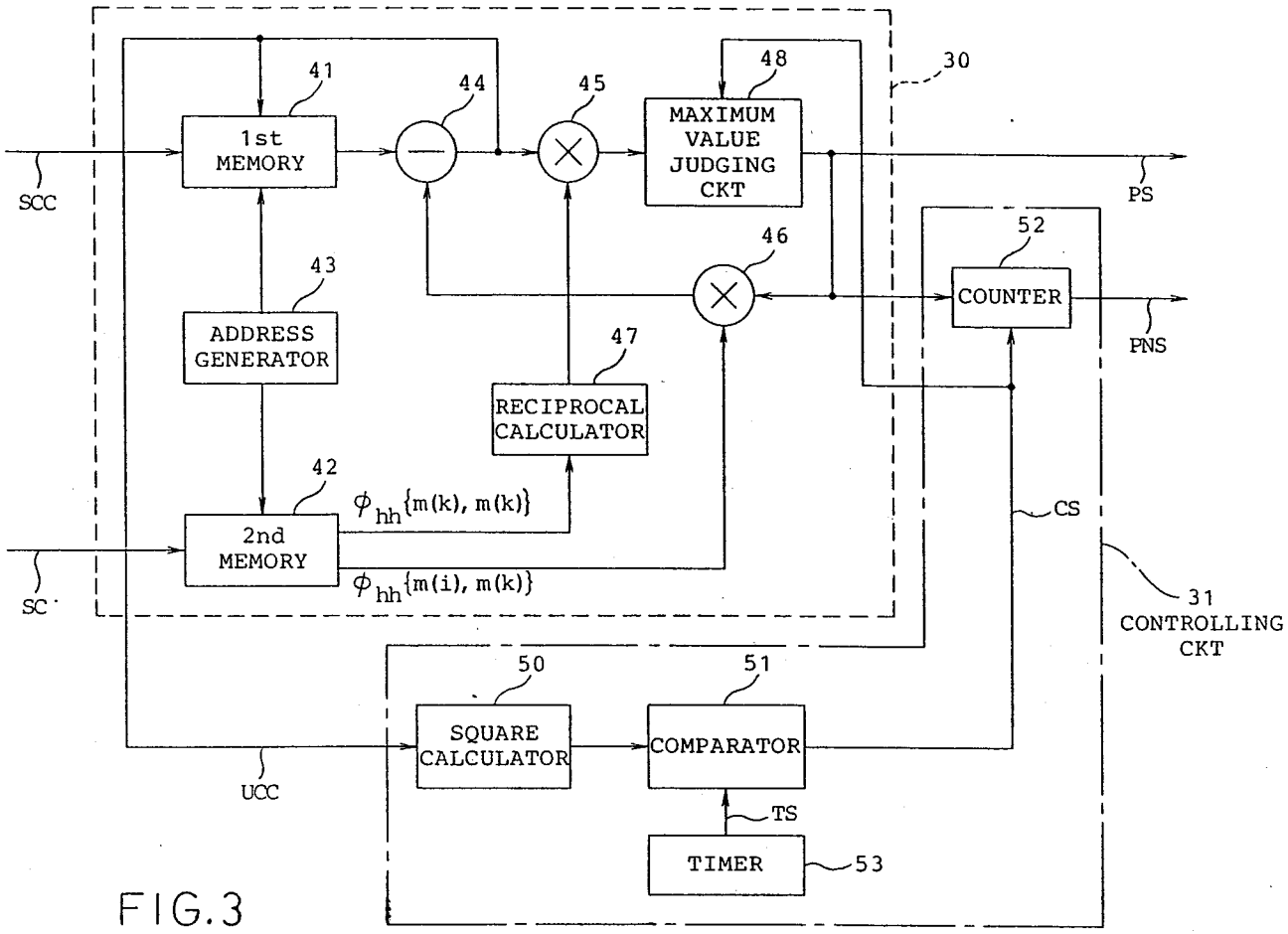
FIG. 3 is a block diagram of a pulse sequence calculating circuit and a controlling circuit which are included in the excitation pulse calculating circuit illustrated in FIG. 2.

Referring afresh to FIG. 3, description will be made as regards the pulse sequence calculating circuit 30 and the controlling circuit 31. The pulse sequence calculating circuit 30 is similar to that disclosed in the Ozawa et al patent except that the pulse sequence calculating circuit 30 produces the updated cross-correlation signal UCC and receives the control signal CS.

A first memory 41 memorizes the cross-correlation signal SCC for each frame. A second memory 42 memorizes the covariance signal SC for each frame. An address generator 43 supplies an address signal to both of the first and the second memories 41 and 42.

A subtractor 44, first and second multipliers 45 and 46, and a reciprocal calculator 47 are used to carry out calculation given by:

$$g(k)\{m(k)\} = \left[\phi_{xh}\{m(k)\} - \sum_{i=1}^{k-1} g(i) \times \phi_{hh}\, m(i), m(k)\}\right] / \phi_{hh}\{m(k), m(k)\},$$

where $\phi_{xh}$ represents a cross-correlation factor; and $\phi_{hh}$ represents a covariance factor. A maximum value judging circuit 48 determines an absolute maximum value of an output signal of the first multiplier 45 so as to determine an optimum amplitude and an optimum location for each excitation pulse. Thus, the maximum value judging circuit 48 generates an excitation pulse sequence.

An output of the subtractor 44 is returned back to the first memory 41 for updating the cross-correlation signal stored in the first memory 41 to the updated cross-correlation signal when the maximum value judging circuit 48 generates each of the excitation pulses. The updated cross-correlation signal represents a sequence of updated cross-correlation factors and is used to generate a next one of the excitation pulses.

Figure 4:
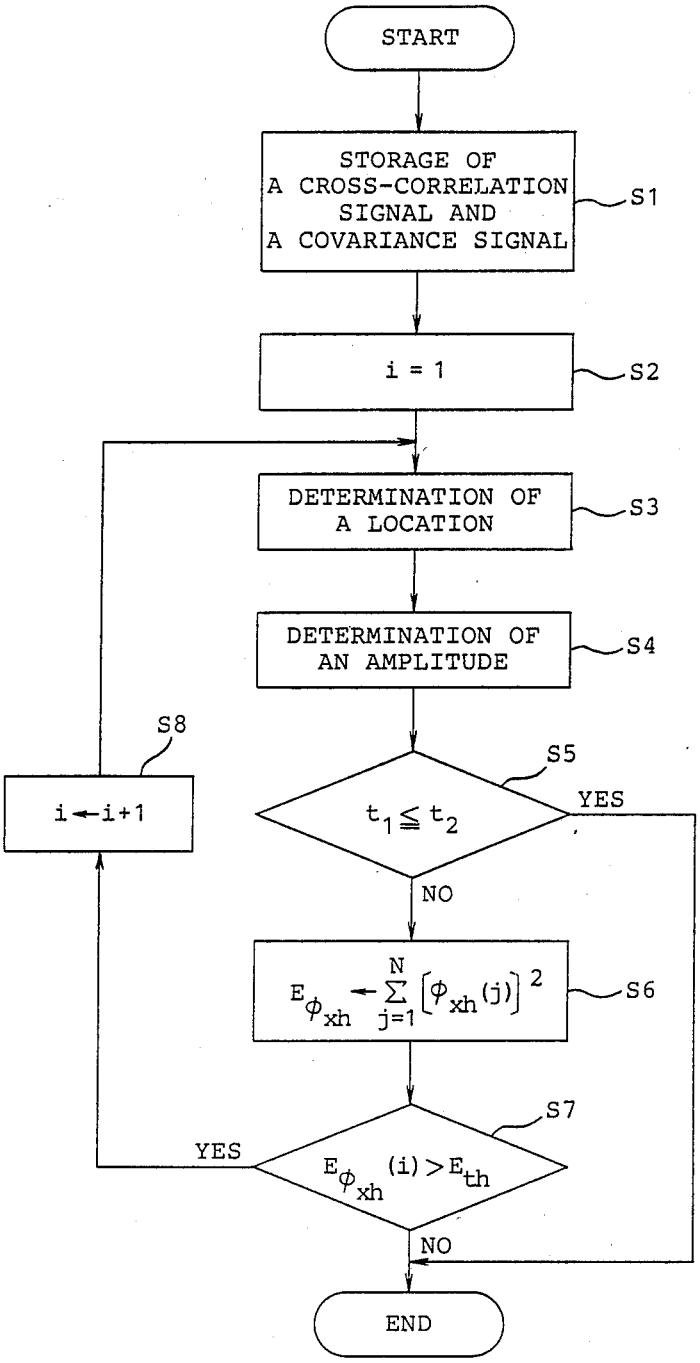
FIG. 4 is a flow chart for use in describing operation of the pulse sequence calculating circuit and the controlling circuit which are illustrated in FIG. 3.

Referring to FIG. 4 together with FIG. 3, description will proceed to calculating operation of the excitation pulses. As will later be described, the calculating operation is carried out within a predetermined time duration $t_1$. For this purpose, a lapse of time for the calculating operation is monitored as an elapsed time duration $t_2$. The controlling circuit 31 comprises a square calculator 50, a comparator 51, a counter 52, and a timer 53.

At a first step Sl, the cross-correlation signal SCC is stored in the first memory 41 while the covariance signal SC is stored in the second memory 42. Subsequently, a variable i is made to be equal to unity at a second step S2 and the timer 53 begins monitoring operation of the elapsed time duration $t_2$. The maximum value judging circuit 48 determines a first location at a third step S3 and then determines a first amplitude in accordance with the first location at a fourth step S4. Thus, a first excitation pulse is calculated.

At a fifth step S5, the elapsed time duration $t_2$ is compared with the predetermined time duration $t_1$ by the timer 53. If the elapsed time duration $t_2$ is shorter than the predetermined time duration $t_1$, the calculating operation should proceed to a sixth step S6. At the sixth step S6, a first updated cross-correlation signal is supplied to the square calculator 50. Supplied with the first updated cross-correlation signal, the square calculator 50 calculates a sum of square values of the updated cross-correlation factors represented by the first updated cross-correlation signal according to:

$$E_{\phi xh}(i) = \sum_{j=1}^{N} [\phi_{xh}(j)]^2.$$

The square calculator 50 sends a sum value signal representative of a sum value to the comparator 51. At a seventh step S7, the comparator 51 compares the sum value with a predetermined value $E_{th}$ and produces a comparison result signal as the control signal CS. The control signal CS represents whether or not the sum value is greater than the predetermined value $E_{th}$. For example, the control signal has a logic zero level when the sum value is greater than the predetermined value $E_{th}$. The control signal has a logic one level when the sum value is not greater than the predetermined value $E_{th}$. If the sum value is greater than the predetermined value $E_{th}$, the calculating operation is returned back to the third step S3 through an eighth step S8 which is for renewing the variable i into (i+1). A second excitation pulse is calculated.

The above-described calculating operation is repeated either until the sum value becomes longer than the predetermined value $E_{th}$ or until the elapsed time duration $t_2$ becomes equal to the predetermined time duration $t_1$. Thus, the maximum value judging circuit 48 generates a plurality of excitation pulses as the pulse signal PS. The counter 52 counts the number of the excitation pulses produced from the maximum value judging circuit 48.

In the fifth step S5, it will be assumed that the elapsed time duration $t_2$ becomes equal to the predetermined time duration $t_1$. In this event, the timer 53 produces a timing signal TS. On reception of the timing signal TS, the comparator 51 produces the control signal CS having logic one level. Supplied with the control signal CS of the logic one level, the maximum value judging circuit 48 and the counter 52 operate as described later.

In the seventh step S7, it will be assumed that the sum value becomes equal to the predetermined value $E_{th}$. In this event, the comparator 51 produces the control signal CS of the logic one level. Supplied with the control signal CS of the logic one level, the maximum value judging circuit 48 stops the calculation. Simultaneously, the counter 52 stops counting operation and produces a count result signal representative of the number of the excitation pulses as the pulse number signal PNS. Thus, the maximum value judging circuit 48 generates the excitation pulses. The number of the excitation pulses is controlled in accordance with the sum value of the updated cross-correlation signal. Instead of the calculation mentioned above, the square calculator 50 may carry out calculation given by:

$$E_{\phi xh}(i) = E_{\phi xh}(i-1) - [g(i).\phi_{hh}\{m(i), m(i)\}]^2.$$

Figure 5:
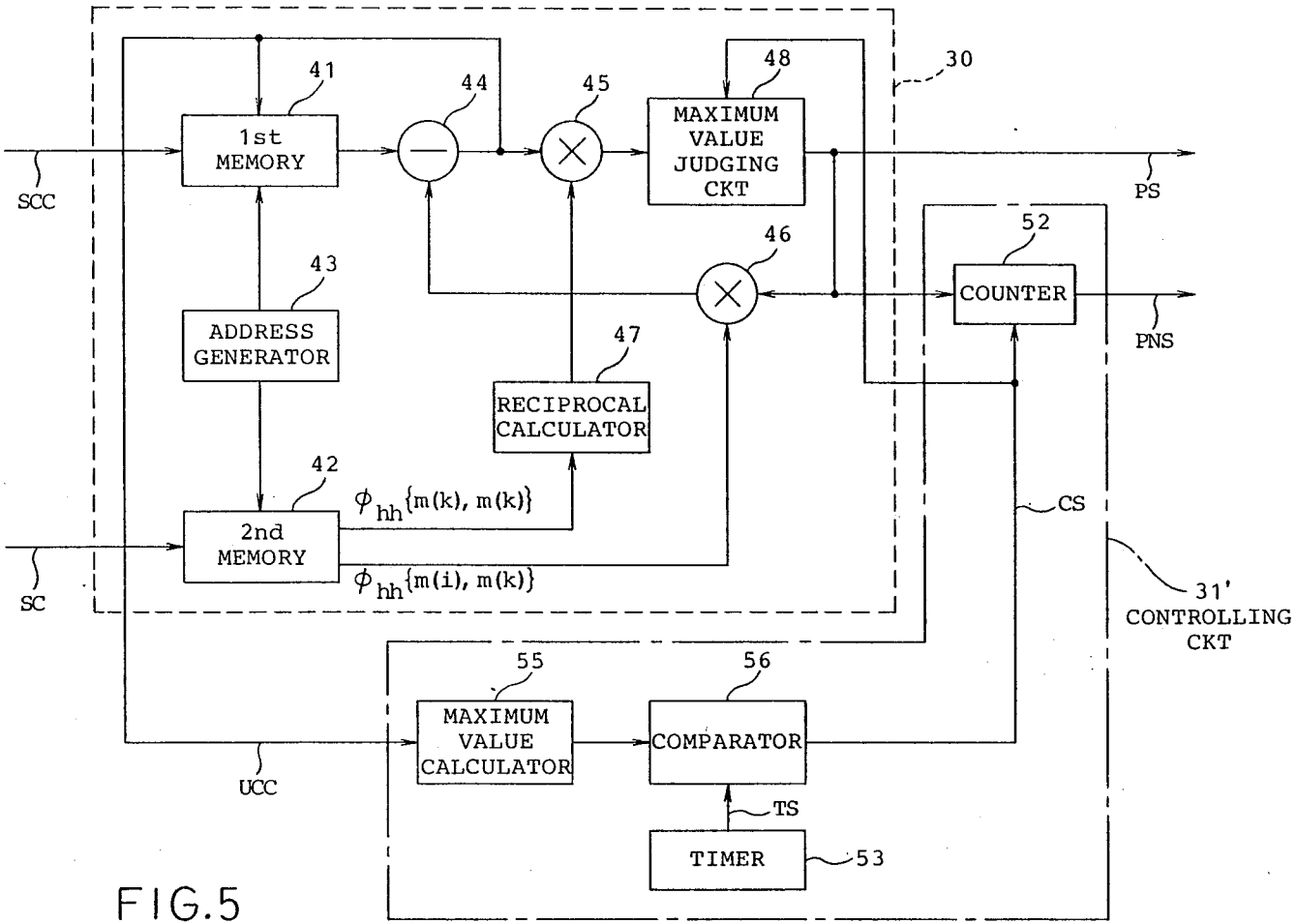
FIG. 5 is a block diagram of the pulse sequence calculating circuit and another type of the controlling circuit illustrated in FIG. 3.
Figure 6:
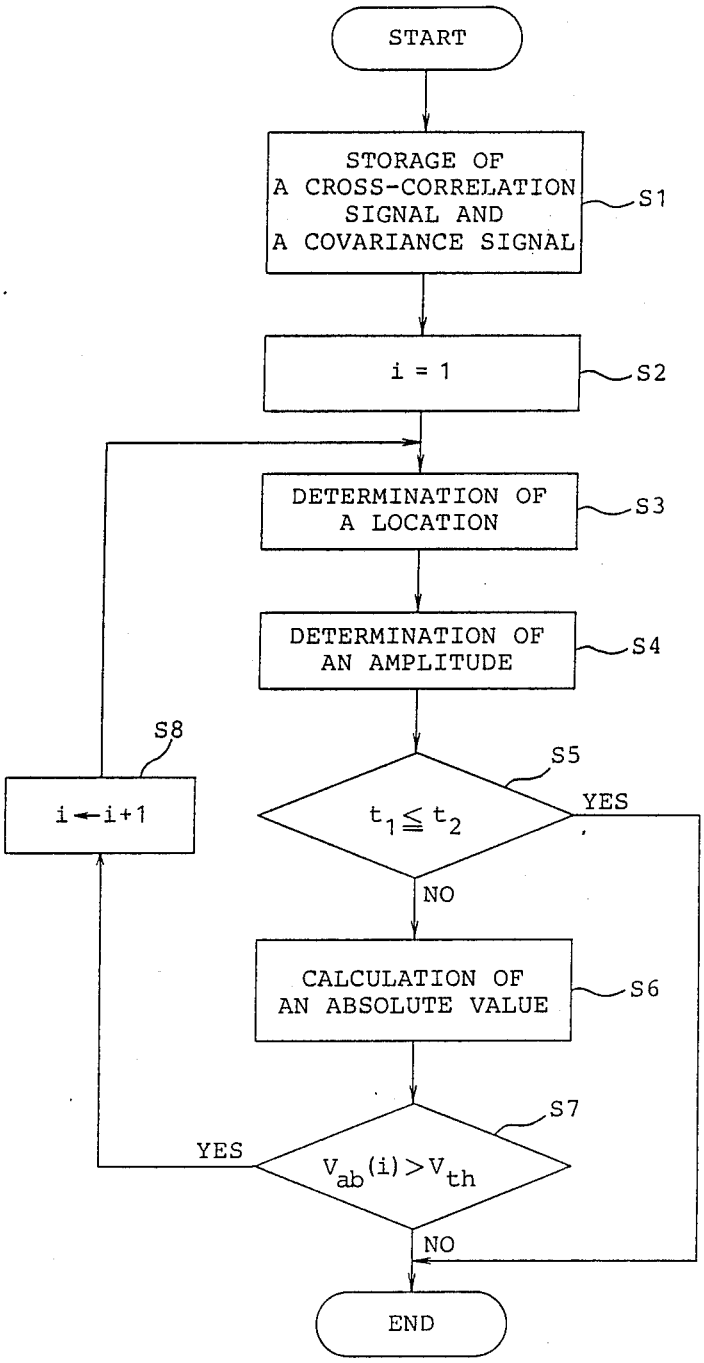
FIG. 6 is a flow chart for use in describing operation of the pulse sequence calculating circuit and the, controlling circuit which are illustrated in FIG. 5.

Referring to FIGS. 5 and 6, description will proceed to another controlling circuit 31' together with the pulse sequence calculating circuit 30. The controlling circuit 31' comprises a maximum value calculator 55, a comparator 56, and the counter 52 similar to that described in FIG. 3. As described before, a lapse of time for the calculating operation is monitored by the timer 53 as the elapsed time duration $t_2$.

At a first step Sl of FIG. 6, the cross-correlation signal SCC is stored in the first memory 41 while the covariance signal SC is stored in the second memory 42. Subsequently, a variable i is made to be equal to unity at a second step S2. The timer 53 begins the monitoring operation of the elapsed time duration $t_2$. The maximum value judging circuit 48 determines a first location at a third step S3 and then determines a first amplitude in accordance with the first location at a fourth step S4. Thus, a first excitation pulse is calculated.

At a fifth step S5 of FIG. 6, the elapsed time duration $t_2$ is compared with the predetermined time duration $t_1$ by the timer 53. If the elapsed time duration $t_2$ is shorter than the predetermined time duration $t_1$, the calculating operation should proceed to a sixth step S6. At the sixth step S6, a first updated cross-correlation signal is supplied to the maximum value calculator 55. The first updated cross-correlation signal represents a sequence of updated cross-correlation factors. Supplied with the first updated cross-correlation signal, the maximum value calculator 55 calculates an absolute value of a maximum value of the updated cross-correlation factors. The maximum value calculator 55 sends a maximum value signal representative of the absolute value to the comparator 56. At a seventh step S7, the comparator 56 compares the absolute value with a predetermined value $V_{th}$ and produces a comparison result signal as the control signal CS. The control signal CS represents whether or not the absolute value is greater than the predetermined value $V_{th}$. For example, the control signal has a logic zero level when the absolute value is greater than the predetermined value $V_{th}$. The control signal has a logic one level when the absolute value is not greater than the predetermined value $V_{th}$. If the absolute value is greater than the predetermined value $V_{th}$, the control operation is returned back to the third step S3 through an eighth step S8. A second excitation pulse is calculated.

The above-described control operation is repeated either until the absolute value $V_{ab}(i)$ of the maximum value signal becomes equal to the predetermined value $V_{th}$ or until the elapsed time duration $t_2$ becomes equal to the predetermined time duration $t_1$. Thus, the maximum value judging circuit 48 generates a plurality of excitation pulses as the pulse signal PS. The counter 52 counts the number of the excitation pulses produced from the maximum value judging circuit 48.

In the fifth step S5, it will be assumed that the elapsed time duration $t_2$ becomes equal to the predetermined time duration $t_1$. In this event, the timer 53 produces a timing signal TS. On reception of the timing signal TS, the comparator 56 produces the control signal CS having logic one level. Supplied with the control signal CS of the logic one level, the maximum value judging circuit 48 and the counter 52 operate as described later.

In the seventh step S7, it will be assumed that the absolute value becomes equal to the predetermined value $V_{th}$. In this event, the comparator 56 produces the control signal CS of the logic one level. Supplied with the control signal CS of the logic one level, the maximum value judging circuit 48 stops the calculation. Simultaneously, the counter 52 stops counting operation and produces a count result signal representative of the number of the excitation pulses as the pulse number signal PNS.

Each of combinations of the pulse sequence calculating circuit 30 and the controlling circuits 31 and 31' may be implemented by a microprocessor. In this event, each of the predetermined time duration $t_1$ and the predetermined values $E_{th}$ and $V_{th}$ is experimentally determined in accordance with capability of the microprocessor.

Figures 7, 8:
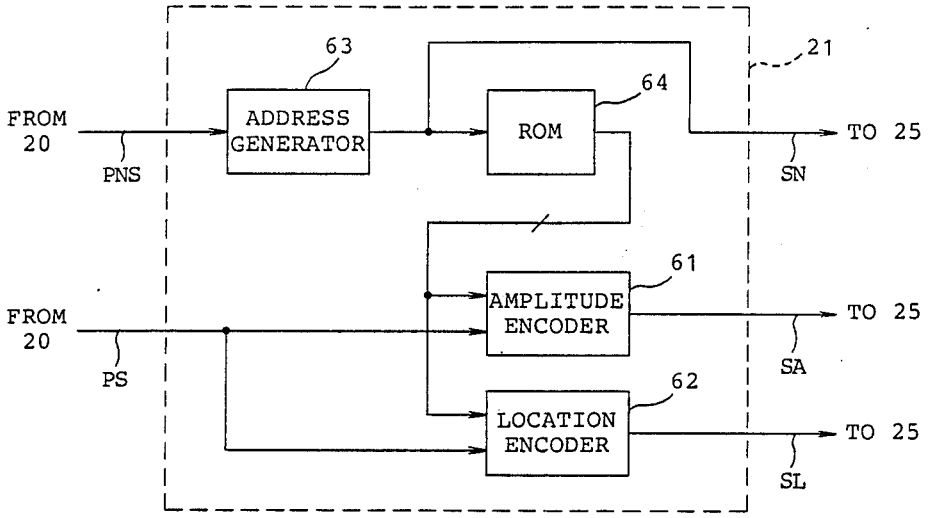
FIG. 7 is a block diagram of an encoding circuit included in the encoder illustrated in FIG. 1.
FIG. 8 is a view for use in describing operation of the pulse sequence calculating circuit and the controlling circuit which are illustrated in FIG. 3.

Referring to FIG. 7, description will be made as regards the encoding circuit 21 which is variable for use in the encoder illustrated in FIG. 1.

The encoding circuit 21 comprises an amplitude encoder 61, a location encoder 62, an address generator 63, and an ROM 64. The amplitude encoder 61 once memorizes the amplitude g(i) of the pulse signal PS and then encodes the amplitude g(i) with a first quantization bit number. The location encoder 62 once memorizes the location m(i) of the pulse signal PS and then encodes the location m(i) with a second quantization bit number. As will later be described, the first quantization bit number is given by one of a plurality of amplitude quantization bit numbers stored in the ROM 64. Similarly, the second quantization bit number is given by one of a plurality of location quantization bit numbers stored in the ROM 64. The address generator 63 is for selecting one of the amplitude quantization bit numbers and one of the location quantization bit numbers in accordance with the pulse number signal PNS representative of the number of the excitation pulses.

Responsive to the pulse number signal PNS, the address generator 63 generates an address signal representing address information which corresponds to the number of the excitation pulses and delivers the address signal to the ROM 64. The address generator 63 further delivers the address signal as the encoded pulse number signal SN to the multiplexer 25 (FIG. 1). By the address signal, one of the amplitude quantization bit numbers and one of the location quantization bit numbers are read out of the ROM 64 as a selected amplitude quantization bit number and a selected location quantization bit number. The amplitude encoder 61 encodes the amplitude g(i) into a first encoded signal represented by the selected amplitude quantization bit number. Similarly, the location encoder 62 encodes the location m(i) into a second encoded signal represented by the selected location quantization bit number. The first and the second encoded signals are supplied to the multiplexer 25 as the encoded amplitude signal SA and the encoded location signal SL, respectively.

The encoding circuit 21 may carry out normalization in the manner mentioned in the Ozawa et al patent. In this event, information of the normalization is represented by a predetermined bit number, such as seven binary bits, as will shortly be described. The information is sent to the multiplexer 25 (FIG. 1) together with the encoded k parameter signal, the encoded amplitude signal SA, the encoded location signal SL, and the encoded pulse number signal SN.

If a total bit number per frame of the multiplexed signal is determined within a predetermined range, the number of the excitation pulses may be one of discrete pulse numbers as will be described in the following.

Referring to FIG. 8 together with FIG. 3, first through eighth pulse numbers are used as the discrete pulse numbers. The first through the eighth pulse numbers may be 19, 21, 25, 27, 30, 39, 45, and 55, respectively. It will be assumed that the pulse sequence calculating circuit 30 is used at a bit rate of 16000 bit/sec.

At first, the calculation of the excitation pulses is continued regardless of the control signal until the pulse number becomes equal to 19. If the control signal has the logic one level when the excitation pulses are calculated up to the first pulse number, the pulse sequence calculating circuit 30 stops the calculation. If the control signal has the logic zero level, the calculation is continued regardless of the control signal until the pulse number becomes equal to 21. If the control signal has the logic one level when the excitation pulses are calculated up to the second pulse number, the pulse sequence calculating circuit 30 stops the calculation. If the control signal has the logic zero level, the calculation is continued regardless of the control signal until the pulse number becomes equal to 25. The above-described control operation is continued until the pulse number becomes equal to 55, until the control signal is given the logic one level, or until the elapsed time duration $t_2$ becomes equal to the predetermined time duration $t_1$.

The first through the eighth pulse numbers are indicated by zeroth through seventh coded values, respectively, each of which is represented by three binary bits. The encoded k parameter signal is represented by 35 binary bits. The information of the normalization is represented by seven binary bits. A first quantization bit number is for quantizing the amplitude g(i) and is given by one of first through eighth amplitude quantization bit numbers. The first through the eighth amplitude quantization bit numbers are equal to 8 through 1 in a decreasing order. A second quantization bit number is for quantizing the location m(i) and is given by one of a plurality of bit numbers. When the excitation pulses are of the first pulse number, the first and the second quantization bit numbers are equal to 8 and 6. When the excitation pulses are of the eighth pulse number, the first and the second quantization bit numbers are equal to 1 and 4.

Thus, the total bit number per frame is determined within a range between 311 and 320 bits.

Figure 9:
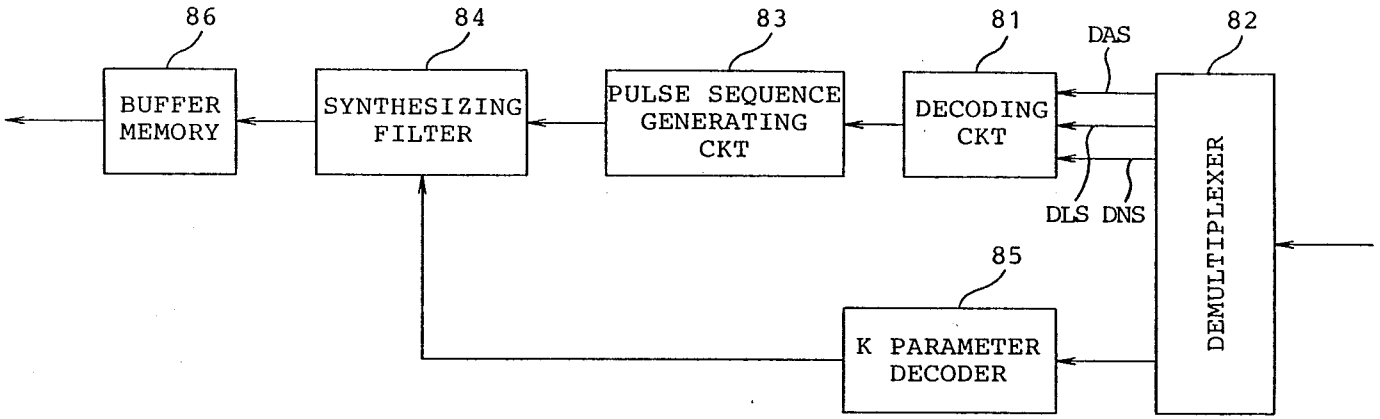
FIG. 9 is a block diagram of a decoder for use as a counterpart of the encoder illustrated in FIG. 1.

Referring to FIG. 9, description will be made as regards a decoder which is for use as a counterpart of the encoder illustrated in FIG. 1. Except for a decoding circuit 81, the decoder is similar to that disclosed in the Ozawa et al patent.

The decoder comprises a demultiplexer 82 supplied with the multiplexed signal through the transmission line. The demultiplexer 82 demultiplexes the multiplexed signal into a demultiplexed amplitude signal DAS, a demultiplexed location signal DLS, a demultiplexed pulse number signal DNS, and a demultiplexed k parameter signal DKS. The demultiplexed amplitude signal DAS, the demultiplexed location signal DLS, the demultiplexed pulse number signal DNS are supplied to the decoding circuit 81.

As will later be described in detail, the decoding circuit 81 decodes the demultiplexed amplitude signal DAS and the demultiplexed location signal DLS into a decoded pulse signal in accordance with the demultiplexed pulse number signal DNS. The decoded pulse signal has an amplitude g'(i) and a location m'(i) and is supplied to a pulse sequence generating circuit 83. Supplied with the encoded pulse signal, the pulse sequence generating circuit 83 generates a plurality of pulses. The number of the pulses is equal to the number represented by the demultiplexed pulse number signal DNS. The pulses generated by the pulse sequence generating circuit 83 are supplied to a synthesizing filter 84.

On the other hand, the demultiplexed k parameter signal DKS is supplied to a k parameter decoder 85. The k parameter decoder 85 decodes the demultiplexed k parameter signal into a decoded k parameter signal and delivers the decoded k parameter signal to the synthesizing filter 84. Supplied with the pulses and the decoded k parameter signal, the synthesizing filter 84 synthesizes the pulses and the decoded k parameter signal into a synthesized signal and sends the synthesized signal to a buffer memory 86. The buffer memory 86 memorizes the synthesized signal as a stored synthesized signal. The stored synthesized signal is read out of the buffer memory 86 as a synthesized speech signal.

Figure 10:
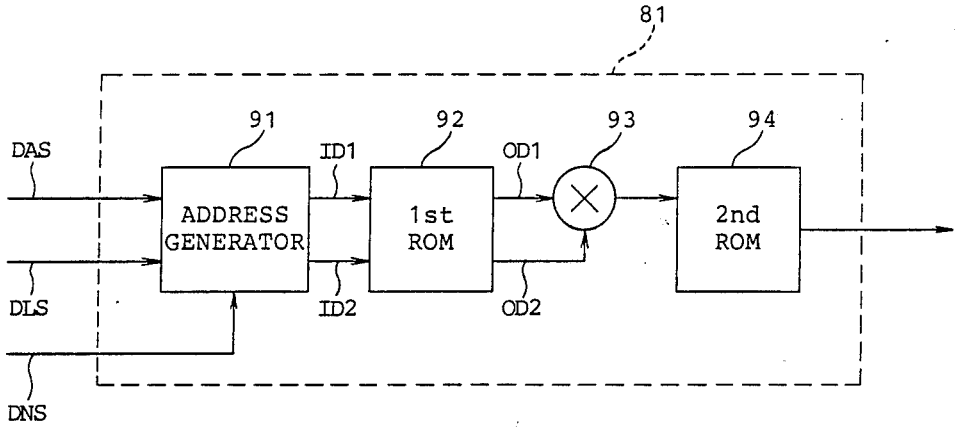
FIG. 10 is a block diagram of a decoding circuit included in the decoder illustrated in FIG. 9.

Referring to FIG. 10, the decoding circuit 81 is similar to that disclosed in the Ozawa et al patent except for an address generator 91. The address generator 91 is supplied with the demultiplexed amplitude signal DAS, the demultiplexed location signal DLS, and the demultiplexed pulse number signal DNS. Responsive to the demultiplexed amplitude signal DAS, the address generator generates a first address information ID1 for a first ROM 92 in accordance with the demultiplexed pulse number signal DNS. Responsive to the demultiplexed location signal DLS, the address generator 91 further generates a second address information ID2 for the first ROM 92 in accordance with the demultiplexed pulse number signal DNS. The first address information is for deriving the amplitude g'(i) while the second address information is for deriving the location m'(i). By the first and the second address information, first and second outputs OD1 and OD2 are read out of the first ROM 92 and supplied to a multiplier 93. The multiplier 93 multiplies the first output OD1 by the second output OD2 and sends a multiplied result as a third address information for a second ROM 94. In accordance with the third address information, an output is read out of the second ROM 94 as the decoded pulse signal having the amplitude g'(i) and the location m'(i).

Figure 11:
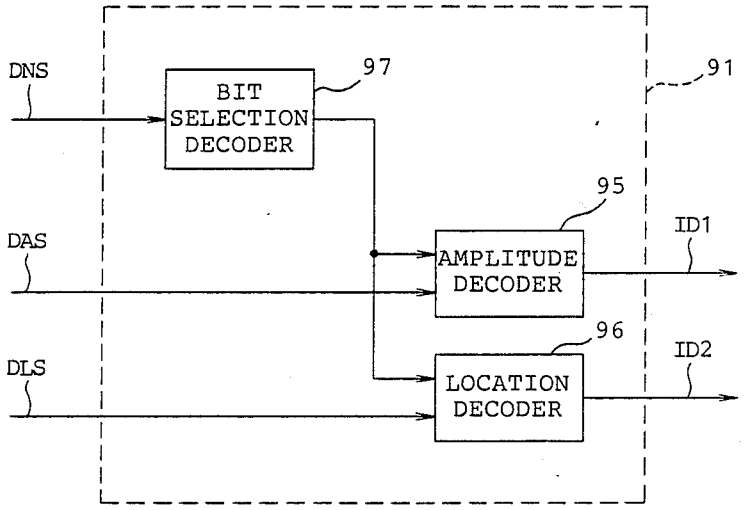
FIG. 11 is a block diagram of an address generator included in the decoding circuit illustrated in FIG. 10.

Referring to FIG. 11, description will proceed to the address generator 91 which is suitable for use in the decoder illustrated in FIG. 9. The address generator 91 comprises an amplitude decoder 95, a location decoder 96, and a bit selection decoder 97. The amplitude decoder 95 decodes the demultiplexed amplitude signal DAS with a first bit number while the location decoder 96 decodes the demultiplexed location signal DLS with a second bit number. The first bit number is given by one of a plurality of amplitude decoding bit numbers stored in the bit selection decoder 97. Similarly, the second bit number is given by one of a plurality of location decoding bit numbers stored in the bit selection decoder 97.

The bit selection decoder 97 selects one of the amplitude decoding bit numbers as a selected amplitude decoding bit number and one of the location decoding bit numbers as a selected location decoding bit number in accordance with the demultiplexed pulse number signal DNS representative of the number of the excitation pulses. The amplitude decoder 95 decodes the demultiplexed amplitude signal DAS into a decoded amplitude signal and produces the decoded amplitude signal as the first address information represented by the selected amplitude decoding bit number. The location decoder 96 decodes the demultiplexed location signal DLS into a decoded location signal and produces the decoded location signal as the second address information represented by the selected location decoding bit number.

While this invention has thus far been described in conjunction with a preferred embodiment thereof, it will readily be possible for those skilled in the art to put this invention into practice in various other manners. For example, the excitation pulse calculating circuit may comprise an autocorrelation calculating circuit instead of the covariance calculating circuit. The comparator may carry out comparing operation between the predetermined time duration and the elapsed time duration.

What is claimed is:

1. An encoder for use in encoding a speech signal into an encoded signal, said speech signal being divided into a succession of frames, said encoder including first means responsive to said speech signal for calculating a sequence of factors in each of said frames to produce a factor signal representative of said factors, second means responsive to said speech signal for calculating cross-correlation in each of said frames to produce a cross-correlation signal representative of said cross-correlation, and pulse sequence calculating means responsive to said speech signal, said factor signal, and said cross-correlation signal for calculating a plurality of excitation pulses in each of said frames, said pulse sequence calculating means updating said cross-correlation signal to an updated cross-correlation signal when said pulse sequence calculating means calculates each of said excitation pulses, said updated cross-correlation signal being for use in calculating a next one of said excitation pulses, wherein the improvement comprises:

control means responsive to said updated cross-correlation signal for producing a control signal;

said pulse sequence calculating means stopping calculation of said excitation pulses at a controlled number of excitation pulses in response to said control signal;

said control means being responsive to said controlled number of excitation pulses for producing a pulse number signal representative of said controlled number.

2. An encoder as claimed in claim 1, said updated cross-correlation signal being representative of a sequence of updated cross-correlation factors for each of said frames, wherein said control means comprises:

square calculating means responsive to said updated cross-correlation signal for calculating a sum of square values of the respective updated cross-correlation factors to produce a square signal representative of said sum;

comparing means responsive to said square signal for comparing said sum with a predetermined value to produce a comparison result signal as said control signal;

said pulse sequence calculating means stopping calculation of said excitation pulses when said sum decreases to said predetermined value; and counting means responsive to said controlled number of excitation pulses and said control signal for counting the number of said controlled number of excitation pulses to produce a count result signal as said pulse number signal 3. An encoder as claimed in claim 1, said updated cross-correlation signal being representative of a sequence of updated cross-correlation factors for each of said frames, wherein said control means comprises:

maximum value calculating means responsive to said updated cross-correlation signal for calculating a maximum value of said updated cross-correlation factors to produce a maximum value signal representative of an absolute value of said maximum value;

comparing means responsive to said maximum value signal for comparing said absolute value with a predetermined value to produce a comparison result signal as said control signal, said pulse sequence calculating means stopping calculation of said excitation pulses when said absolute value decreases to said predetermined value; and counting means responsive to said controlled number of excitation pulses and said control signal for counting the number of said controlled number of excitation pulses to produce a count result signal as said pulse number signal.

4. An encoder as claimed in claim 2 or 3, wherein said control means further comprises timer means for monitoring a lapse of time for calculation of said excitation pulses as an elapsed time duration, said timer means comparing said elapsed time duration with a predetermined time duration and producing a timing signal when said elapsed time duration becomes equal to said predetermined time duration, said comparing means further producing said comparison result signal in response to said timing signal.

5. An encoder as claimed in claim 1, said controlled number of excitation pulses having amplitudes and locations wherein said encoder further comprises:

encoding means coupled to said pulse sequence calculating means and said control means for encoding the amplitudes and the locations of the controlled number of excitation pulses with first and second bit numbers into encoded amplitudes and encoded locations and for encoding said pulse number signal with a predetermined bit number into an encoded pulse number signal, said first and said second bit numbers being determined in accordance with said controlled number, said encoded signal comprising said encoded amplitudes, said encoded locations, and said encoded pulse number signal for each of said frames.

* * * * *